US009098040B2

(12) United States Patent
Ishizaki

(10) Patent No.: US 9,098,040 B2
(45) Date of Patent: Aug. 4, 2015

(54) IMAGE FORMING APPARATUS, AND IMAGE CARRIER MOVING APPARATUS FOR USE IN IMAGE FORMING APPARATUS

(71) Applicant: KYOCERA Document Solutions Inc., Osaka-shi, Osaka (JP)

(72) Inventor: Atsushi Ishizaki, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/137,801

(22) Filed: Dec. 20, 2013

(65) Prior Publication Data

US 2014/0184717 A1 Jul. 3, 2014

(30) Foreign Application Priority Data

Dec. 27, 2012 (JP) ..... 2012-284719

(51) Int. Cl.
*G03G 15/043* (2006.01)
*G03G 15/01* (2006.01)
*G03G 15/00* (2006.01)

(52) U.S. Cl.
CPC ..... *G03G 15/5008* (2013.01); *G03G 15/0189* (2013.01); *G03G 2215/00974* (2013.01)

(58) Field of Classification Search
CPC ..... G03G 2215/00974
USPC ..... 399/301, 51
See application file for complete search history.

(56) References Cited

U.S. PATENT DOCUMENTS

| | | | | |
|---|---|---|---|---|
| 4,425,036 | A * | 1/1984 | Kameyama et al. | 399/167 |
| 4,833,502 | A | 5/1989 | Azuma | |
| 4,982,239 | A * | 1/1991 | Kume et al. | 399/349 |
| 2012/0008994 | A1* | 1/2012 | Tomita | 399/301 |
| 2012/0163866 | A1* | 6/2012 | Morishita | 399/167 |

FOREIGN PATENT DOCUMENTS

| | | | |
|---|---|---|---|
| JP | 61124966 | A * | 6/1986 |
| JP | 62014171 | A | 1/1987 |

* cited by examiner

*Primary Examiner* — David Gray
*Assistant Examiner* — Tyler Hardman
(74) *Attorney, Agent, or Firm* — Alleman Hall McCoy Russell & Tuttle LLP

(57) ABSTRACT

An exposure portion scans, in an axial direction, light which is emitted from a light source based on image data of a document sheet, and applies the light to surfaces of image carriers, to form an electrostatic latent image on each image carrier. The cleaning member is disposed so as to contact with each image carrier and removes residual toner on each image carrier, to perform cleaning. The driving mechanism causes each image carrier to shuttle in the axial direction with a predetermined amplitude while the image carrier is driven to rotate. The detecting member detects positional information representing a position, in the axial direction, obtained when each image carrier shuttles. The control portion controls, based on a result of detection by the detecting member, a time when scanning on each of the image carriers by the exposure portion is to be started.

2 Claims, 10 Drawing Sheets

IMAGE FORMING APPARATUS, AND IMAGE CARRIER MOVING APPARATUS FOR USE IN IMAGE FORMING APPARATUS

INCORPORATION BY REFERENCE

This application is based upon and claims the benefit of priority from the corresponding Japanese Patent Application No. 2012-284719 filed on Dec. 27, 2012, the entire contents of which are incorporated herein by reference.

BACKGROUND

The present disclosure relates to image forming apparatuses such as copy machines, printers, facsimile apparatuses, and multifunction peripherals having the entirety or some of functions of the apparatuses and machines, and image carrier moving apparatuses for use in the image forming apparatuses.

An image forming apparatus forms a toner image on an image carrier, and transfers the toner image to a transfer medium such as a paper sheet, and thereafter removes residual toner on the image carrier to perform cleaning. Cleaning blades structured so as to be pressed against the image carriers are widely used in order to remove residual toner on the image carriers. Foreign objects such as paper dust may be caught in the cleaning blade. A technique is known in which, in such a case, the cleaning blade and the image carrier are moved relative to each other in the axial direction in order to remove residual toner without scratching the surface of the image carrier due to the foreign objects caught in the cleaning blade.

For example, in some of conventional image forming apparatuses, the image carrier is rotated, and a shuttling drive mechanism is actuated by the rotational movement to shuttle the image carrier in the axial direction. In this case, in a state where the image carrier is shuttled while rotating, the cleaning blade is caused to contact with the surface of the image carrier, thereby removing residual toner without scratching the surface of the image carrier.

SUMMARY

An image forming apparatus according to one aspect of the present disclosure includes a plurality of image carriers, an exposure portion, a developing device, an intermediate transfer medium, a cleaning member, a driving mechanism, a detecting member, and a control portion. The exposure portion scans, in an axial direction, light which is emitted from a light source based on image data of a document sheet, and applies the light to a surface of each of the image carriers, to form an electrostatic latent image on each of the image carriers. The developing device develops the electrostatic latent image formed by the exposure portion, into a toner image. The intermediate transfer medium travels in a direction in which the plurality of image carriers are aligned, and, on the intermediate transfer medium, the toner image obtained by development on each image carrier by the developing device is sequentially superimposed. The cleaning member is disposed so as to contact with each image carrier and removes residual toner on each image carrier, to perform cleaning. The driving mechanism causes each image carrier to shuttle in the axial direction with a predetermined amplitude while the image carrier is driven to rotate. The detecting member detects positional information representing a position, in the axial direction, obtained when each image carrier shuttles. The control portion controls, based on a result of detection by the detecting member, a time when scanning on each of the image carriers by the exposure portion is to be started.

An image carrier moving apparatus according to another aspect of the present disclosure includes a plurality of image carriers, an exposure portion, a developing device, an intermediate transfer medium, a cleaning member, a driving mechanism, and a detecting member. The exposure portion scans, in an axial direction, light which is emitted from a light source based on image data of a document sheet, and applies the light to a surface of each of the image carriers, to form an electrostatic latent image on each of the image carriers. The developing device develops the electrostatic latent image formed by the exposure portion, into a toner image. The intermediate transfer medium travels in a direction in which the plurality of image carriers are aligned, and, on the intermediate transfer medium, the toner image obtained by development on each image carrier by the developing device is sequentially superimposed. The cleaning member is disposed so as to contact with each image carrier and removes residual toner on each image carrier, to perform cleaning. The driving mechanism causes each image carrier to shuttle in the axial direction with a predetermined amplitude while the image carrier is driven to rotate. The detecting member detects positional information representing a position, in the axial direction, obtained when each image carrier shuttles.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the drawings. However, the present disclosure is not limited to the embodiments. Further, usage of the present disclosure, terms used herein, or the like is not limited.

First Embodiment

Figure 1:
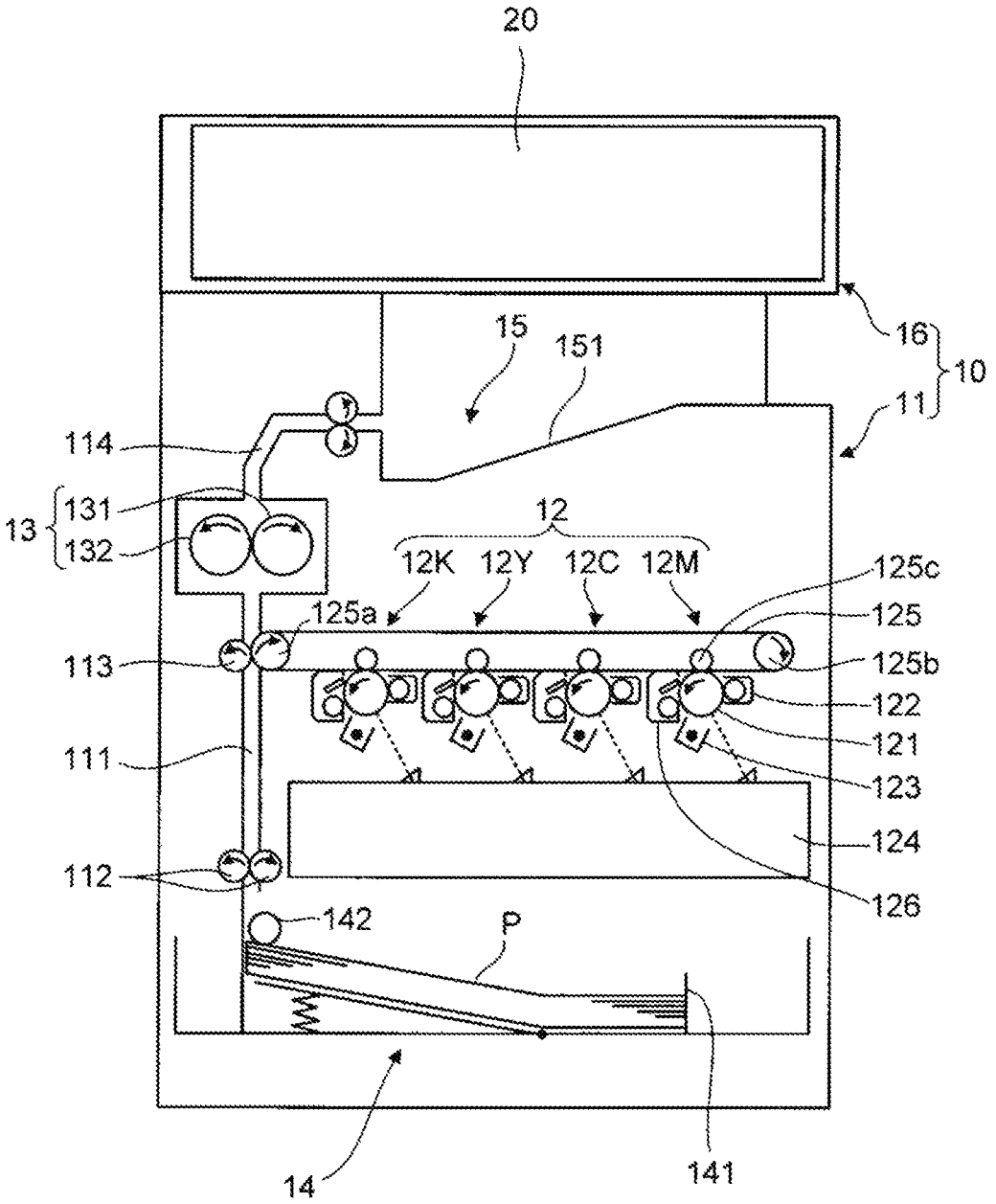
FIG. 1 is a cross-sectional view of an image forming apparatus according to a first embodiment of the present disclosure.

FIG. 1 is a cross-sectional view of an image forming apparatus according to embodiments of the present disclosure. An image forming apparatus 10 is a tandem-type color copying machine using an in-body sheet discharging manner, and includes a lower apparatus body 11 and an upper apparatus body 16.

The lower apparatus body 11 includes a sheet feed portion 14, an image forming portion 12, and a fixing device 13. The upper apparatus body 16 includes an image reading portion 20 that reads a document sheet image. A sheet discharge space 15 is formed between the lower apparatus body 11 and the upper apparatus body 16, and a paper sheet P having an image fixed thereon is discharged into the sheet discharge space 15.

The image forming portion 12 forms a toner image on a paper sheet P fed from the sheet feed portion 14, and includes a magenta-color unit 12M, a cyan-color unit 12C, a yellow-color unit 12Y, and a black-color unit 12K that are aligned from the upstream side toward the downstream side in a rotation direction of an intermediate transfer belt 125 which is an intermediate transfer medium.

In each of the image forming units 12M, 12C, 12Y, and 12K, a photosensitive member 121 that is an image carrier is disposed. A developing device 122, an exposure portion 124, a charging portion 123, and a cleaning portion 126 are disposed around each photosensitive member 121.

The developing device 122 is disposed to the right of the photosensitive member 121 so as to oppose the photosensitive member 121, and supplies toner to the photosensitive member 121. The charging portion 123 is disposed upstream of the developing device 122 in a rotation direction of the photosensitive member 121, so as to oppose the surface of the photosensitive member 121, and the surface of the photosensitive member 121 is uniformly charged.

The exposure portion 124 scans and exposes the photosensitive member 121 based on image data, such as characters and pictures, read by the image reading portion 20, and the exposure portion 124 is disposed below the photosensitive member 121. The exposure portion 124 includes a laser light source, a polygon mirror, and the like, which are not shown, and laser light emitted from the laser light source is applied, through the polygon mirror, to the surface of the photosensitive member 121 from a portion downstream of the charging portion 123 in the rotation direction of the photosensitive member 121. An electrostatic latent image is formed on the surface of the photosensitive member 121 due to the applied laser light. The electrostatic latent image is developed into a toner image by the developing device 122.

The intermediate transfer belt 125 that is an endless belt is extended on and between a driving roller 125*a* and a tension roller 125*b*. The driving roller 125*a* is driven to rotate by a not-illustrated motor, and the intermediate transfer belt 125 is circulation-driven by rotation of the driving roller 125*a*.

The photosensitive members 121 can contact with and move away from the intermediate transfer belt 125, and the photosensitive members 121 are disposed adjacent to each other and aligned below the intermediate transfer belt 125 and along the traveling direction of the intermediate transfer belt 125. Primary transfer rollers 125*c* oppose the photosensitive members 121 across the intermediate transfer belt 125, and are pressed against the intermediate transfer belt 125, to form a primary transfer portion. In the primary transfer portion, the toner images of the photosensitive members 121 are sequentially superimposed on each other on the intermediate transfer belt 125 at predetermined times, respectively, according to rotation of the intermediate transfer belt 125, thereby performing transfer operation by the primary transfer rollers 125*c*. Thus, toner images of four colors, that is, magenta, cyan, yellow, and black colors are superimposed to form a toner image on the surface of the intermediate transfer belt 125. After the primary transfer, the cleaning portions 126 remove residual toner on the surfaces of the photosensitive members 121, thereby performing cleaning.

A secondary transfer roller 113 is disposed so as to oppose the driving roller 125*a* across the intermediate transfer belt 125, and is pressed against the intermediate transfer belt 125, to form a secondary transfer portion. In the secondary transfer portion, the toner image on the surface of the intermediate transfer belt 125 is transferred to a paper sheet P. After the transfer, a not-illustrated belt cleaning device removes residual toner on the intermediate transfer belt 125, thereby performing cleaning.

In the lower portion of the image forming apparatus 10, the sheet feed portion 14 is disposed, and the paper sheets P are stored in the sheet feed portion 14. The sheet feed portion 14 includes a paper sheet tray 141 that is detachably mounted to the apparatus body 11. A first paper sheet conveying path 111 is disposed to the left of the sheet feed portion 14. In the first paper sheet conveying path 111, a paper sheet P fed from the paper sheet tray 141 by a pickup roller 142 is conveyed to the secondary transfer portion of the intermediate transfer belt 125 by conveying rollers 112. Further, the fixing device 13 that performs fixing process for the paper sheet P having the toner image transferred thereto, and a second paper sheet conveying path 114 through which the paper sheet P on which the fixing process has been performed is conveyed to a paper sheet discharge tray 151, are disposed in the upper left portion of the apparatus body 11.

The paper sheet P is conveyed to the secondary transfer portion such that a time when the toner image is to be transferred to the paper sheet P by the secondary transfer roller 113 meets a time when the sheet feeding operation is to be performed. Onto the paper sheet P having been conveyed to the secondary transfer portion, the toner image on the intermediate transfer belt 125 is secondarily transferred by the secondary transfer roller 113 to which a transfer bias is applied, and the paper sheet P is conveyed to the fixing device 13.

The fixing device 13 includes a fixing roller 131 that is heated by a heat source and a pressure roller 132 that is disposed so as to be pressed against the fixing roller 131, and the paper sheet P having the toner image transferred thereto is heated and pressurized, thereby performing fixing process. The paper sheet P having the toner image fixed thereon is discharged through the second paper sheet conveying path 114 to the paper sheet discharge tray 151 by a discharge roller.

Figure 2A:
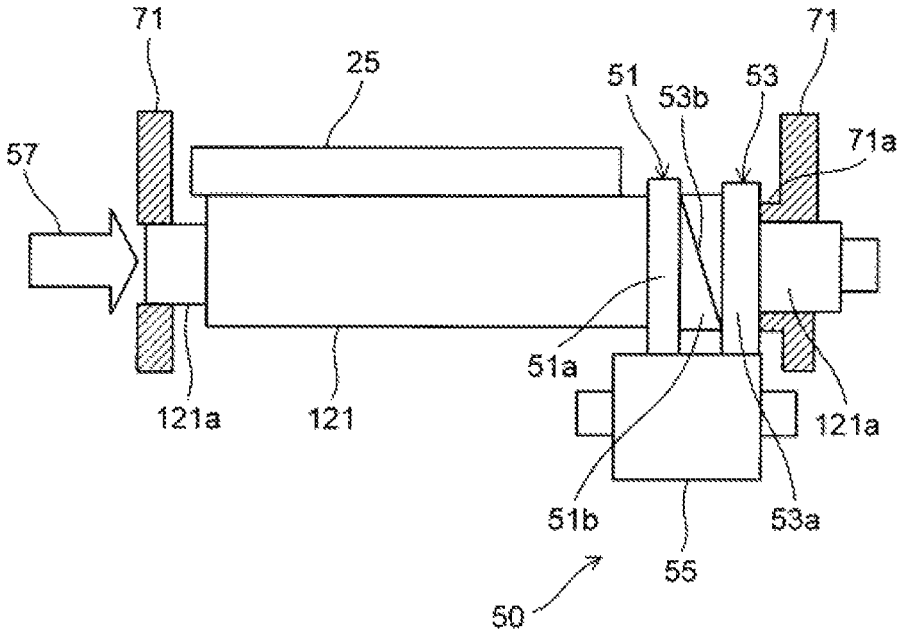
FIG. 2A and FIG. 2B are each a plan view of a driving mechanism of an image carrier according to the first embodiment of the present disclosure.
Figure 2B:
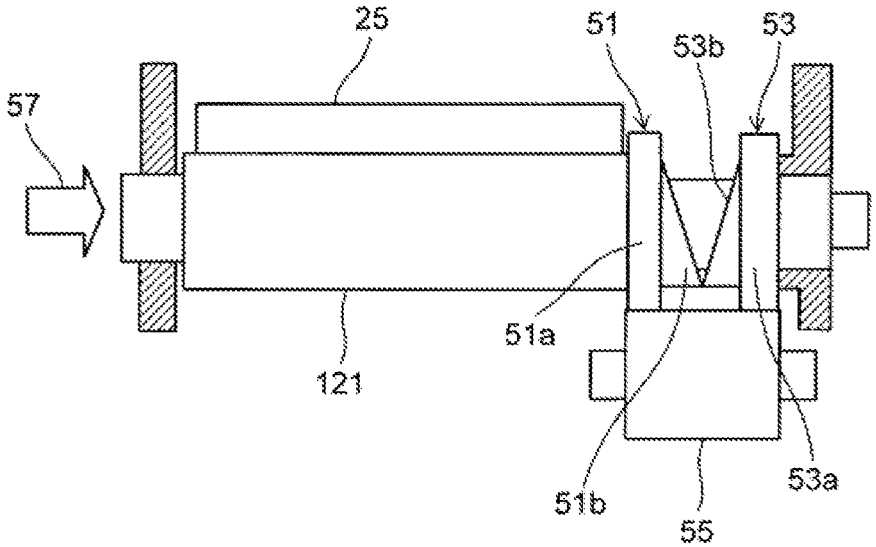
Figure 3:
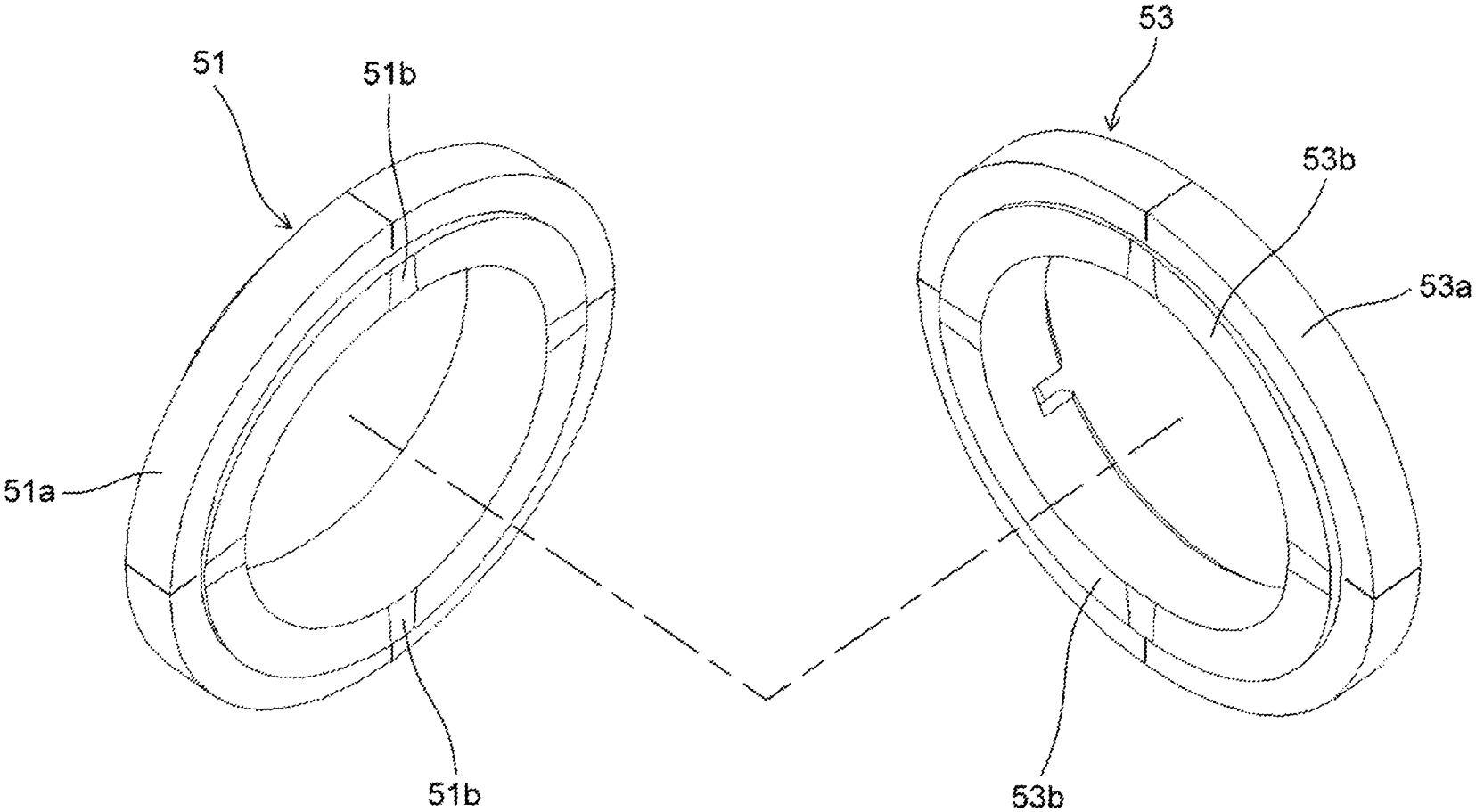
FIG. 3 is a perspective view of a first gear member and a second gear member of the driving mechanism according to the first embodiment of the present disclosure.
Figure 4:
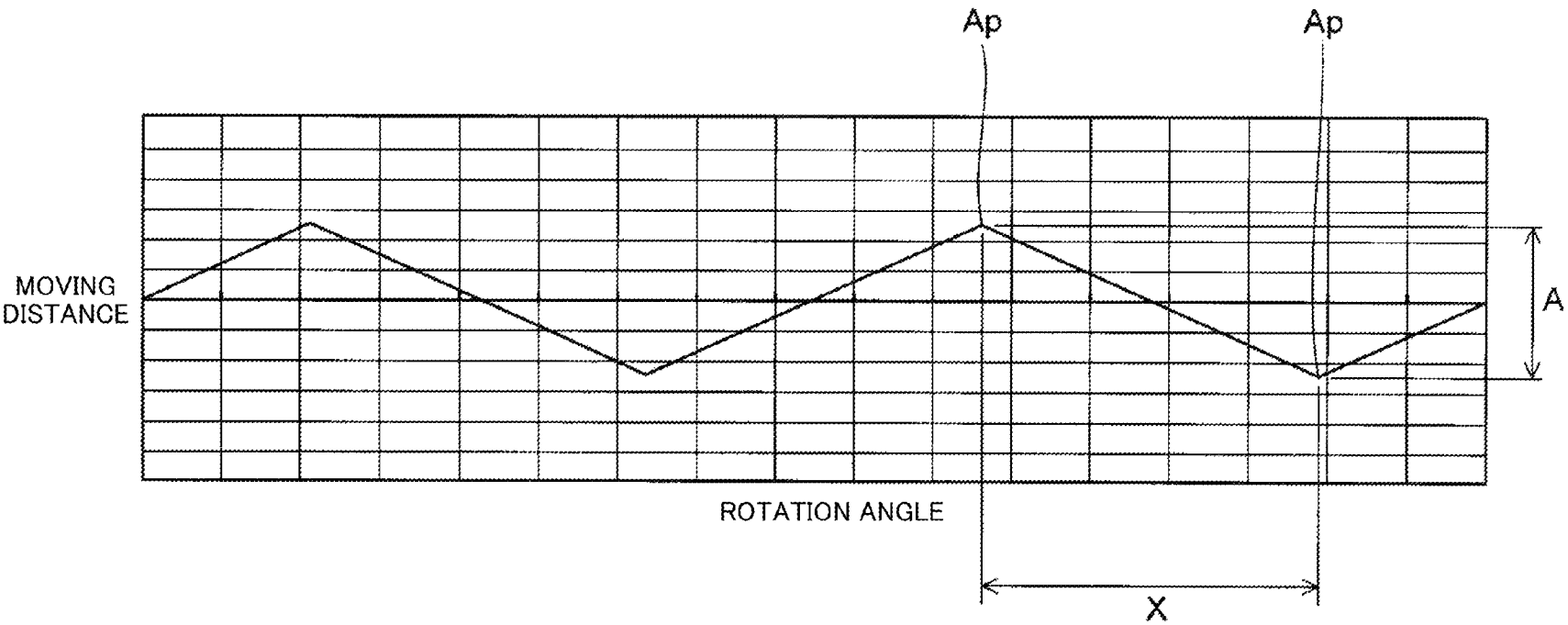
FIG. 4 illustrates a relationship between a rotation angle and a moving distance in an axial direction for a photosensitive member, according to the first embodiment of the present disclosure.

Next, a structure of an apparatus for cleaning each photosensitive member 121 will be described with reference to FIGS. 2 to 4. FIG. 2A and FIG. 2B are each a plan view of a driving mechanism 50 that moves the photosensitive member 121 in the axial direction. The photosensitive member 121 shuttles between a position shown in FIG. 2A and a position shown in FIG. 2B. FIG. 3 is a perspective view illustrating a first gear member 51 and a second gear member 53 of the driving mechanism 50 in a separated state. FIG. 4 illustrates a relationship between a rotation angle and a moving distance in the axial direction, for the photosensitive member 121.

As shown in FIG. 2A, a cleaning blade 25 that is a cleaning member, and the driving mechanism 50 are disposed around each photosensitive member 121.

The cleaning blade 25 is fixed to the cleaning portion 126 (see FIG. 1) so as to contact with the surface of the photosensitive member 121, and removes residual toner on the surface of the photosensitive member 121.

The photosensitive member 121 includes a rotation shaft 121*a* that extends toward both end portions in the axial direction, and the first gear member 51 disposed on the right side in the axial direction. The rotation shaft 121*a* is fitted into support members 71 (drum unit) on both end sides so as to be movable in the axial direction and rotatable.

The driving mechanism 50 includes the first gear member 51 described above, the second gear member 53, a driving gear 55, and an urging member 57.

The first gear member 51 includes a first gear 51*a* and a cam follower 51*b*. The first gear 51*a* is a spur gear formed on the outer circumferential surface of the first gear member 51. The cam follower 51*b* is a projection that projects from the right side surface of the first gear member 51, and contacts with a cam surface 53*b* described below.

The second gear member 53 includes a second gear 53*a* and the cam surface 53*b*. The second gear member 53 has a right side surface that contacts with a flange portion 71*a* of the support member 71. The second gear member 53 is rotatably mounted to the rotation shaft 121*a* of the photosensitive member 121.

The second gear 53*a* is formed on the outer circumferential surface of the second gear member 53, and is a spur gear that has teeth formed such that the number of teeth of the second gear 53*a* is less than the number of teeth of the first gear 51*a* of the first gear member 51, by one. Further, the second gear 53*a* has a shifted tooth profile such that a diameter of a pitch circle of the second gear 53*a* meets a diameter of a pitch circle of the first gear 51*a*. Since the second gear 53*a* is structured as a profile shifted gear, the driving gear 55 assuredly meshes with the first gear 51*a* and the second gear 53*a*.

The cam surface 53*b* is formed on the left side surface of the second gear member 53 so as to oppose the cam follower 51*b* of the first gear member 51, such that a distance in the axial direction varies (is displaced) in the circumferential direction.

Specifically, as shown in FIG. 3, two cam surfaces 53*b* are formed on the left side surface of the second gear member 53 so as to be spaced from each other by 180 degrees in the circumferential direction. Each of the cam surfaces 53*b* is provided such that a distance in the axial direction varies (is displaced) by a predetermined amount for each unit rotational angle in the circumferential direction of the cam surface 53*b*. The first gear member 51 has two cam followers 51*b* that are spaced from each other by 180 degrees in the circumferential direction so as to oppose the cam surfaces 53*b* of the second gear member 53. The cam follower 51*b* moves in the axial direction according to a position where the cam follower 51*b* and the cam surface 53*b* contact with each other, and the photosensitive member 121 having the cam follower 51*b* moves in the axial direction integrally with the cam follower 51*b*.

Returning to FIG. 2A, the driving gear 55 is rotatably supported by an apparatus body (not shown), and includes a spur gear that meshes with the first gear 51*a* and the second gear 53*a*.

The urging member 57 is implemented as a coil spring that presses the rotation shaft 121*a* of the photosensitive member 121 rightward so as to allow the cam follower 51*b* to contact with the cam surface 53*b*.

When the photosensitive member 121 is driven to rotate together with the first gear member 51 by a not-illustrated motor, the driving gear 55 that meshes with the first gear 51*a* rotates, and further the second gear 53*a* that meshes with the driving gear 55 rotates, that is, the second gear member 53 rotates. The first gear member 51 and the second gear member 53 rotate together. However, the rotation rate of the first gear member 51 and the rotation rate of the second gear member 53 are different from each other due to the number of teeth being different between the first gear 51*a* and the second gear 53*a*. When the first gear member 51 and the second gear member 53 rotate at different rotation rates, a contact position at which the cam follower 51*b* and the cam surface 53*b* contact with each other varies, and the photosensitive member 121 moves, while rotating, in the axial direction against an urging force of the urging member 57 according to the contact position. Consequently, the photosensitive member 121 reaches a position shown in FIG. 2B. When the first gear member 51 is driven to further rotate, the photosensitive member 121 moves rightward in the state shown in FIG. 2B, and returns to the position shown in FIG. 2A. The driving gear 55 may be driven to rotate by a motor, and the first gear member 51 and the second gear member 53 may be caused to rotate together by the rotation of the driving gear 55, instead of the photosensitive member 121 being driven to rotate by a not-illustrated motor.

When the driving mechanism 50 causes the first gear member 51 and the second gear member 53 to rotate, the photosensitive member 121 shuttles as indicated by a solid line in FIG. 4. In FIG. 4, the horizontal axis represents rotation angles of the first gear member 51 (the photosensitive member 121), and the vertical axis represents moving distances of the photosensitive member 121. In the description herein, the first gear 51*a* (see FIG. 2A and FIG. 2B) has a predetermined number of teeth, and the number of teeth of the second gear 53*a* (see FIG. 2A and FIG. 2B) is set so as to be less than the number of teeth of the first gear 51*a*, by one. Further, the cam surface 53*b* always moves by a constant distance in the axial direction for each unit rotational angle, and a maximum displacement amount (amplitude), in the axial direction, of the cam surface 53*b* is defined as A. Namely, while the photosensitive member 121 rotates by a predetermined rotation angle X, a peak Ap, at one movement end, of the amplitude A shifts to a peak Ap, at the other movement end, of the amplitude A.

When the cleaning blade 25 removes residual toner on the surface of the photosensitive member 121, the photosensitive member 121 rotates and shuttles in the axial direction with the amplitude A, whereby the residual toner is less likely to be caught between the photosensitive member 121 and the cleaning blade 25. As a result, residual toner on the photosensitive member 121 can be removed to perform cleaning without scratching the surface of the photosensitive member 121.

As described above, the photosensitive members 121 of the image forming units 12M, 12C, 12Y, and 12K, respectively, rotate and move in the axial direction, and thus the photosensitive members 121 are cleaned by the cleaning blades 25, respectively. When the four photosensitive members 121 individually move in the axial direction, the toner images of the photosensitive members 121 may be transferred to the intermediate transfer belt 125 (see FIG. 1) at different positions, respectively, and color shift in the axial direction may occur.

In the present embodiment, in order to avoid color shift, the peak Ap (see FIG. 4) of the amplitude A which is positional information about positions, in the axial direction, where each of the photosensitive members 121 shuttles, is detected, and a time when scanning on the photosensitive member 121 by the exposure portion 124 is to be started is controlled based on the positional information (the peak Ap of the amplitude A). Due to this control, the toner images of the respective colors formed on the photosensitive members 121, are transferred to the intermediate transfer belt 125 at the same position in the axial direction, and the toner images of the four colors are not displaced in the axial direction on the intermediate transfer belt 125, and color shift is avoided.

Figure 5:
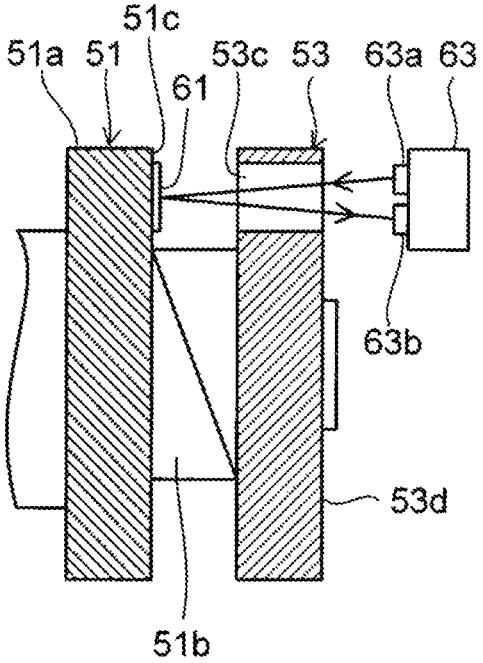
FIG. 5 is a side view illustrating positioning of a detecting member according to the first embodiment of the present disclosure.
Figure 6A:
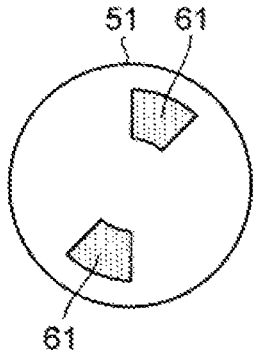
FIG. 6A and FIG. 6B are plan views of reflecting surfaces and through holes according to the first embodiment of the present disclosure.
Figure 6B:
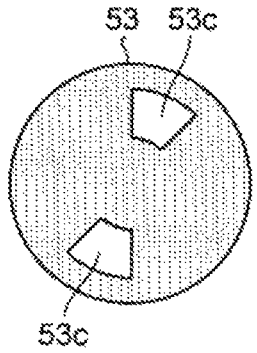
Figure 7A:
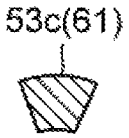
FIG. 7A, FIG. 7B, and FIG. 7C are each a plan view illustrating relative movement between the reflecting surface and the through hole according to the first embodiment of the present disclosure.
Figure 7B:
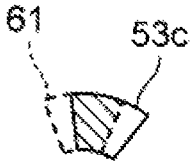
Figure 7C:
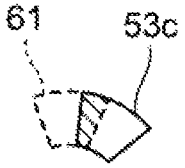
Figure 8:
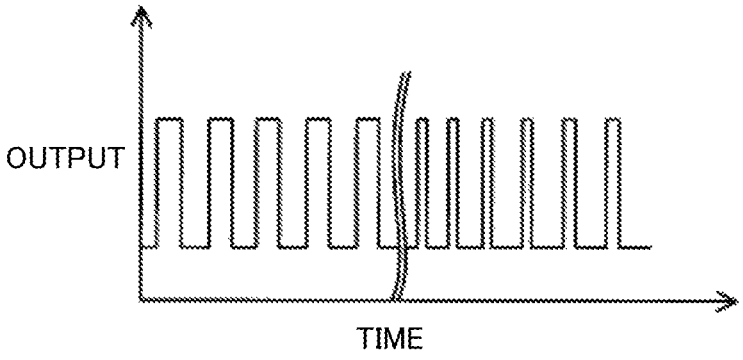
FIG. 8 illustrates an output signal of the detecting member according to the first embodiment of the present disclosure.
Figure 9:
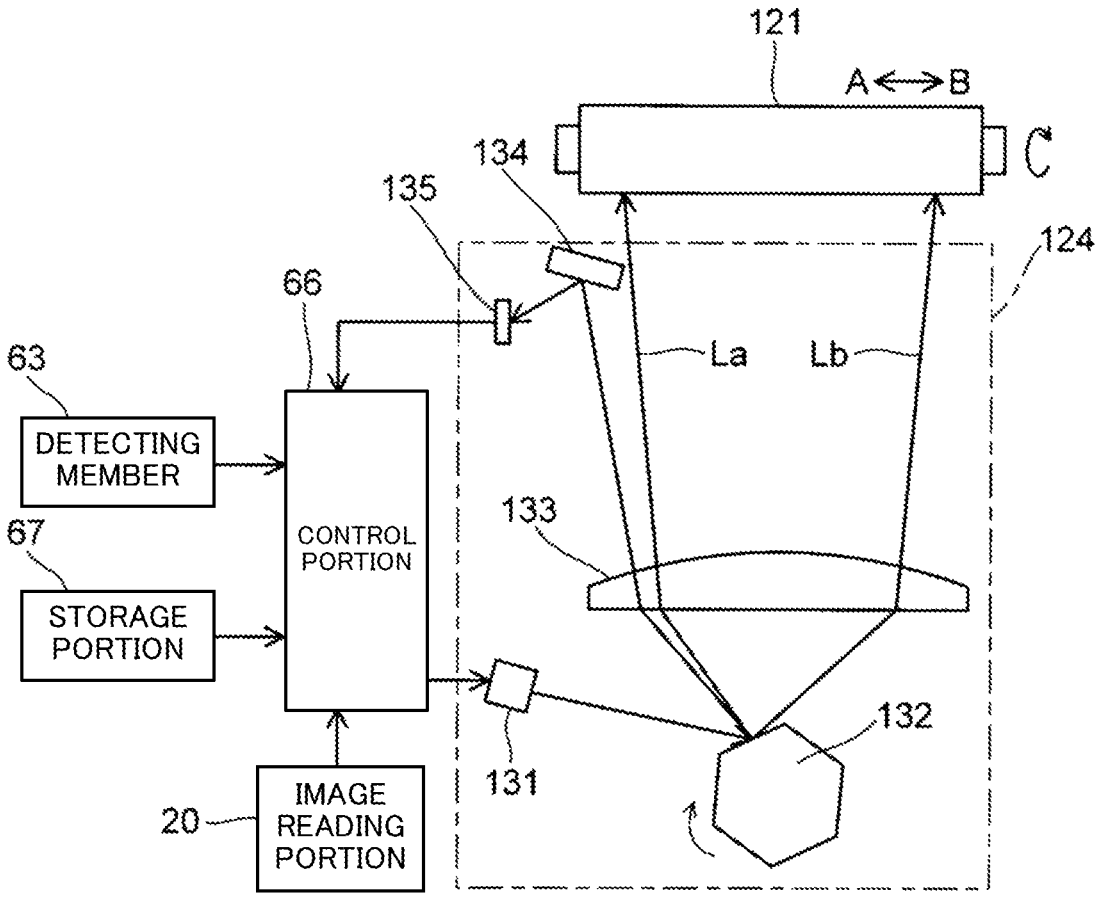
FIG. 9 is a block diagram illustrating control of optical scanning on the image carrier by an exposure portion according to the first embodiment of the present disclosure.

A structure that enables avoidance of color shift will be described with reference to FIG. 5 to FIG. 9. FIG. 5 is a side view illustrating positioning of a detecting member 63. In FIG. 5, the driving gear 55 is not shown. FIG. 6A and FIG. 6B are plan views illustrating reflecting surfaces 61 (FIG. 6A) of the first gear member 51, and through holes 53*c* (FIG. 6B) formed in the second gear member 53. FIG. 7A to FIG. 7C are each a plan view illustrating relative movement between the reflecting surface 61 and the through hole 53*c*. FIG. 8 shows a waveform of a pulse signal obtained when the horizontal axis represents a time and the vertical axis represents an output of the detecting member 63. FIG. 9 is a block diagram illustrating control of optical scanning on the photosensitive member 121 by the exposure portion 124.

As shown in FIG. 5, the reflecting surfaces 61 are provided on a side surface portion 51*c* of the first gear member 51. The reflecting surfaces 61 are formed by a sheet material that is made of, for example, aluminium, and that reflects light. The reflecting surfaces 61 are fixed to the side surface portion 51*c* at positions outward of the cam follower 51*b* of the first gear member 51 in the radial direction. Further, as shown in FIG. 6A, the two reflecting surfaces 61 are disposed at positions distant from the rotation center of the first gear member 51 by the same distance, and are each sector-shaped, and the two reflecting surfaces 61 are point-symmetric with respect to the rotation center of the first gear member 51.

Further, as shown in FIG. 5, the second gear member 53 has the through holes 53*c* formed at positions opposing the reflecting surfaces 61. As shown in FIG. 6B, the two through holes 53*c* are disposed at positions distant from the rotation center of the second gear member 53 by the same distance and each have the same sector shape as each reflecting surface 61, and the two through holes 53*c* are point-symmetric with respect to the rotation center of the second gear member 53. The shape of the reflecting surfaces 61 and the through holes 53*c* is not limited to the sector shape, and may be selected from among, for example, a rectangular shape and a round shape as appropriate such that the reflecting surfaces 61 and the through holes 53*c* have the same shape and the same size. Further, although two sets of the reflecting surface 61 and the through hole 53*c* are provided in the present embodiment, the number of the sets is not limited to two. One set of the reflecting surface 61 and the through hole 53*c* may be provided.

The first gear member 51 and the second gear member 53 rotate at different rotation rates, respectively. Therefore, the reflecting surfaces 61 of the first gear member 51 deviate, in position in the circumferential direction, from the through holes 53*c* of the second gear member 53 according to rotations of the first gear member 51 and the second gear member 53. Namely, as shown in FIG. 7A, when the reflecting surfaces 61 are positioned so as to oppose the through holes 53*c*, the entirety of the reflecting surfaces 61 is exposed through the through holes 53*c* (the diagonal line portion in FIG. 7A). According to rotations of the first gear member 51 and the second gear member 53, the reflecting surfaces 61 deviate from the through holes 53*c* in the circumferential direction, and a part of each reflecting surface 61 is exposed through the through holes 53*c* (the diagonal line portion in FIG. 7B), as shown in FIG. 7B. According to the first gear member 51 and the second gear member 53 being further rotated, exposure of each reflecting surface 61 through the through holes 53*c* is further reduced (the diagonal line portion in FIG. 7C), as shown in FIG. 7C.

In the present embodiment, the first gear member 51 and the second gear member 53, and the driving gear 55 (see FIG. 2A and FIG. 2B) are structured such that, when the cam follower 51*b* (see FIG. 3) of the first gear member 51 is positioned, at a position corresponding to one of the peaks Ap (see FIG. 4) of the amplitude A, relative to the cam surface 53*b* (see FIG. 3) of the second gear member 53, the reflecting surfaces 61 and the through holes 53*c* oppose each other (the state shown in FIG. 7A), that is, exposure of the reflecting surfaces 61 through the through holes 53*c* becomes maximum.

Returning to FIG. 5, the detecting member 63 is implemented as a light sensor, and includes a light emitting portion 63*a* and a light receiving portion 63*b* that are disposed so as to oppose a side surface portion 53*d* of the second gear member 53. The light emitting portion 63*a* is implemented as a light emitting element such as a LED, and applies light to the reflecting surface 61. The light receiving portion 63*b* is implemented as a light receiving element such as a photodiode, and receives light reflected by the reflecting surface 61.

The detecting member 63 applies light through the through hole 53*c* of the second gear member 53 to the reflecting surface 61 of the first gear member 51, and receives, through the through hole 53*c*, light reflected by the reflecting surface 61, to output a signal associated with shuttling of the photosensitive member 121.

Specifically, as shown in FIG. 8, by the photosensitive member 121 moving in the axial direction while rotating, the detecting member 63 receives light reflected by the reflecting surface 61 each time the photosensitive member 121 makes a half rotation, to detect one pulse of light. As shown in FIG. 7A to FIG. 7C, when the photosensitive member 121 continuously rotates, an exposed area of the reflecting surface 61 is changed, and a pulse width (pulse output time) is changed according to the exposed area of the reflecting surface 61 being changed. When the reflecting surface 61 and the through hole 53*c* are positioned as shown in FIG. 7A, the pulse width (pulse output time) becomes maximum. Namely, when the photosensitive member 121 is positioned at a position corresponding to one of the peaks Ap (see FIG. 4) of the amplitude A, the pulse width (pulse output time) becomes maximum. When the reflecting surface 61 and the through hole 53*c* shift from the state shown in FIG. 7A to the state shown in FIG. 7B, and further shift to the state shown in FIG. 7C, the pulse output time is gradually reduced. The detecting member 63 outputs the pulse signal to a control portion 66 shown in FIG. 9. The control portion 66 controls, based on the pulse output time, a time when scanning on the photosensitive member 121 by the exposure portion 124 is to be started.

As shown in FIG. 9, the exposure portion 124 includes: a laser light unit 131 that emits light beam; a polygon mirror 132 that rotates to deflect and scan the light beam; a scanning optical system 133 including components such as an fθ lens that transforms the light beam reflected by the polygon mirror 132 for scanning at a constant speed; a mirror 134 that reflects the light beam from the scanning optical system 133, toward a detection sensor 135; and the detection sensor 135 that outputs a signal according to the received light beam.

The laser light unit 131 emits light beam obtained by modulating image data from the image reading portion 20, toward the polygon mirror 132. The polygon mirror 132 reflects the light beam emitted from the laser light unit 131, and rotates to deflect and scan the reflected light. The scanning optical system 133 transforms the light beam reflected by the polygon mirror 132 for scanning at a constant speed, to form an image on the photosensitive member 121. Thus, the exposure portion 124 scans one line for an effective exposure region, by light beams ranging from a scanning start light beam La to a scanning end light beam Lb, to form an electrostatic latent image on the photosensitive member 121.

The detection sensor 135 is implemented as a light sensor such as a photodiode, and is disposed so as to receive light beam outside the effective exposure region on the scanning start light beam La side. A light beam emitted prior to the scanning start light beam La is incident on the detection sensor 135 through the mirror 134, and the detection sensor 135 outputs, to the control portion 66, a timing signal according to the light beam. The control portion 66 determines, according to the timing signal, a time when scanning by the exposure portion 124 is to be started. The detection sensor 135 may be disposed outside the effective exposure region on the scanning end light beam Lb side.

Specifically, the control portion 66 includes: a microcomputer; a storage portion such as a RAM and a ROM; a time measuring portion that measures various times necessary for control; and the like. The control portion 66 performs various calculations based on, for example, programs and data stored in the RAM and the ROM, a signal inputted from the image reading portion 20, a signal inputted from the detecting member 63, and axial direction movement data for the driving mechanism 50 (see FIG. 2A and FIG. 2B) and axial direction and rotation direction data for the photosensitive member 121, which are inputted from a storage portion 67, thereby controlling a time when image data is to be outputted to the laser light unit 131.

In a case where the photosensitive members 121 move in the axial direction while rotating, when scanning start times for the four photosensitive members 121 are different, color shift occurs. However, a scanning time for the scanning start light beam La based on the output of a timing signal from the detection sensor 135 is corrected, whereby scanning times for the scanning start light beams La for respective colors meet each other.

Specifically, the detecting member 63 outputs, to the control portion 66, an output signal associated with a maximum pulse width (pulse output time), and the control portion 66 determines the peak Ap of the amplitude A based on the signal associated with the maximum output time of pulsed light which is inputted from the detecting member 63, and further corrects the scanning time for the scanning start light beam La based on information representing the peak Ap of the amplitude A. Namely, a pulse signal of a maximum output time (time when the amplitude A represents the peak Ap) is inputted to the control portion 66 from the detecting member 63 of each photosensitive member 121 immediately before image formation. Subsequently, the control portion 66 calculates a difference among times of the pulse signals of the maximum output times, based on each pulse signal of the maximum output time, and stores, in the storage portion 67, the difference among the times of the pulse signals of the maximum output times for each photosensitive member 121. When an image is formed, the control portion 66 corrects each scanning time for the scanning start light beam La, based on the difference among times of the pulse signals of the maximum output times for the photosensitive members 121, and axial direction movement data and rotation direction data for the photosensitive members 121. Thus, transfer positions in the axil direction meet each other when toner images of the colors formed on the photosensitive members 121, respectively, are transferred to the intermediate transfer belt 125. As a result, the toner images of the four colors are transferred to the intermediate transfer belt 125 so as to be superimposed on each other, thereby obtaining an image in which no color shift occurs.

Second Embodiment

Figure 10:
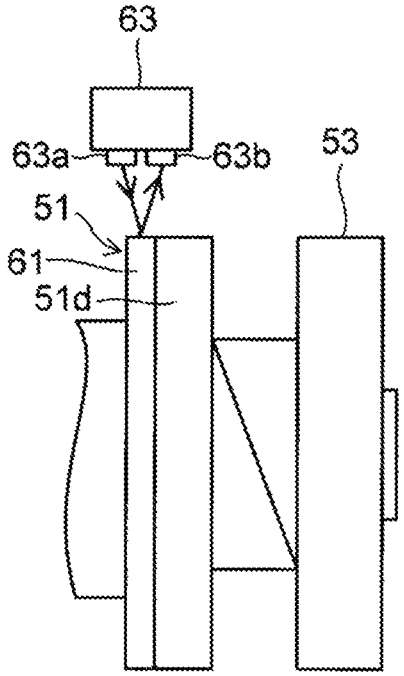
FIG. 10 is a side view illustrating positioning of a detecting member according to a second embodiment of the present disclosure.

FIG. 10 is a side view illustrating positioning of a detecting member 63 according to a second embodiment of the present disclosure. The detecting member 63 and a reflecting surface 61 having structures different from those of the first embodiment will be mainly described, and description of the same components as described for the first embodiment is not given. In FIG. 10, the driving gear 55 is not shown.

The reflecting surface 61 is disposed on an outer circumferential surface portion 51*d* of the first gear member 51. The reflecting surface 61 is formed by a sheet member that is made of, for example, aluminium, and that reflects light. The reflecting surface 61 is fixed to the outer circumferential surface portion 51*d*. Further, the reflecting surface 61 is disposed at a position, of the outer circumferential surface portion 51*d*, at which the first gear 51*a* (see FIG. 2A and FIG. 2B) is not disposed, over the entirety of the circumference of the outer circumferential surface portion 51*d*, so as to have a predetermined width in the axil direction.

The detecting member 63 is implemented as a light sensor, and includes a light emitting portion 63*a* and a light receiving portion 63*b* disposed so as to oppose the reflecting surface 61. The light emitting portion 63*a* is implemented as a light emitting element such as a LED, and applies light to the reflecting surface 61. The light receiving portion 63*b* is implemented as a light receiving element such as a photodiode, and receives light reflected by the reflecting surface 61.

The detecting member 63 receives light reflected by the reflecting surface 61, and outputs a signal associated with an amount of received light that changes according to movement of the first gear member 51 (the photosensitive member 121) in the axial direction. When the center portion of the reflecting surface 61 opposes the detecting member 63 according to movement of the photosensitive member 121 in the axial direction, an amount of received light becomes maximum. On the other hand, when the end portion of the reflecting surface 61 opposes the detecting member 63, an amount of received light is reduced.

In the present embodiment, the detecting member 63 is disposed relative to the reflecting surface 61 such that, when the cam follower 51*b* (see FIG. 3) of the first gear member 51 is positioned, at a position corresponding to one of the peaks Ap (see FIG. 4) of the amplitude A, relative to the cam surface 53*b* (see FIG. 3) of the second gear member 53, the detecting member 63 opposes the center portion of the reflecting surface 61, that is, an amount of light received by the detecting member 63 becomes maximum.

The detecting member 63 outputs, to the control portion 66, an output signal associated with a maximum amount of received light. The control portion 66 determines the peak Ap of the amplitude A, based on the signal associated with a maximum amount of received light, which is inputted from the detecting member 63, and further corrects a scanning time for the scanning start light beam La, based on information representing the peak Ap of the amplitude A. Namely, a signal (time when the amplitude A represents the peak Ap) representing a maximum amount of received light is inputted to the control portion 66 from the detecting member 63 of each photosensitive member 121 immediately before image formation. Subsequently, the control portion 66 calculates a difference among times of the maximum amounts of received light based on each signal representing the maximum amount of received light, and stores, in the storage portion 67, the difference among times of the maximum amounts of received light for each photosensitive member 121. When an image is formed, the control portion 66 corrects each scanning time for the scanning start light beam La, based on the difference among times of the maximum amounts of received light for the photosensitive members 121, and axial direction movement data and rotation direction data for the photosensitive members 121. Thus, transfer positions in the axial direction meet each other when the toner images of the colors formed on the photosensitive members 121, respectively, are transferred to the intermediate transfer belt 125. As a result, the toner images of the four colors are transferred to the intermediate transfer belt 125 so as to be superimposed on each other without occurrence of position shift in the axial direction, thereby obtaining an image in which no color shift occurs.

In the first and the second embodiments, the detecting member 63 detects, as positional information, the peak Ap (see FIG. 4) of the amplitude A with which the photosensitive member 121 shuttles. However, the present disclosure is not limited thereto. The detecting member 63 may detect, as positional information, a predetermined location in the amplitude A.

The present disclosure is applicable to image forming apparatuses such as copy machines, printers, facsimile apparatuses, and multifunction peripherals having the entirety or some of functions of the apparatuses and machines, and image carrier moving apparatuses for use in the image forming apparatuses. In particular, the present disclosure is applicable to color-image forming apparatuses in which toner images are formed on a plurality of image carriers, and the toner images on the image carriers are superimposed on each other on an intermediate transfer medium, and image carrier moving apparatuses for use in the color-image forming apparatuses.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a plurality of image carriers;

an exposure portion that scans, in an axial direction, light which is emitted from a light source based on image data of a document sheet, and applies the light to a surface of each of the image carriers, to form an electrostatic latent image on each of the image carriers;

a developing device that develops the electrostatic latent image formed by the exposure portion into a toner image;

an intermediate transfer medium which travels in a direction in which the plurality of image carriers are aligned, and on which the toner image obtained by development on each image carrier by the developing device is sequentially superimposed;

a cleaning member that is disposed so as to contact with each image carrier and that removes residual toner on each image carrier to perform cleaning;

a driving mechanism that causes each image carrier to shuttle in the axial direction with a predetermined amplitude while the image carrier is driven to rotate;

a detecting member that detects positional information representing a position, in the axial direction, obtained when each image carrier shuttles; and a control portion that controls, based on a result of detection by the detecting member, a time when scanning on each of the image carriers by the exposure portion is to be started; wherein the driving mechanism includes:

a first gear member that is provided in each of the image carriers;

a second gear member that is disposed so as to oppose the first gear member and be rotatable coaxially with the first gear member, the second gear member disposed so as not to be movable in the axial direction, the second gear member having teeth formed such that the number of the teeth of the second gear member is different from the number of teeth of the first gear member;

a driving gear that meshes with the first gear member and the second gear member;

a cam surface that is provided in one of the first gear member and the second gear member such that a distance in the axial direction varies in a circumferential direction;

a cam follower that is provided in the other of the first gear member and the second gear member so as to contact with the cam surface; and an urging member that urges each of the image carriers in a direction in which the cam surface and the cam follower come into contact with each other;

the first gear member includes a reflecting surface by which light is reflected, such that the reflecting surface is positioned at a predetermined position, in a circumferential direction, of a side surface portion;

the second gear member includes a through hole opposing the reflecting surface; and the detecting member:

includes a light emitting portion that applies light through the through hole to the reflecting surface, and a light receiving portion that receives, through the through hole, light reflected by the reflecting surface; and detects peak positions of amplitudes with which the image carriers shuttle, based on an output time period in which the reflected light is outputted, the output time period being changed according to a difference between a rotation angle of the first gear member and a rotation angle of the second gear member.

2. The image forming apparatus according to claim 1, wherein the control portion calculates, based on the peak positions, a difference among the peak positions for the image carriers, and controls a time when scanning on each image carrier by the exposure portion is to be started, based on the difference among the peak positions.

* * * * *